US006347951B1

(12) United States Patent
Murr

(10) Patent No.: US 6,347,951 B1
(45) Date of Patent: Feb. 19, 2002

(54) ZERO INSERTION FORCE SOCKET ACTUATION TOOL

(75) Inventor: Keith McQuilkin Murr, Etters, PA (US)

(73) Assignee: The Whitaker Corporation, Wilmington, DE (US)

( * ) Notice: Subject to any disclaimer, the term of this patent is extended or adjusted under 35 U.S.C. 154(b) by 0 days.

(21) Appl. No.: 09/439,395

(22) Filed: Nov. 15, 1999

(51) Int. Cl.[7] ..... H01R 4/50
(52) U.S. Cl. ..... 439/342
(58) Field of Search ..... 439/259, 342, 439/263, 264, 265, 266, 268

(56) References Cited

U.S. PATENT DOCUMENTS

| | | | | | |
|---|---|---|---|---|---|
| 4,080,032 | A | * | 3/1978 | Cherian et al. | 439/268 |
| 4,420,205 | A | * | 12/1983 | Kirkman | 439/266 |
| 4,531,792 | A | * | 7/1985 | Oshitani et al. | 439/70 |
| 4,538,870 | A | * | 9/1985 | Thewlis | 439/329 |
| 4,950,980 | A | * | 8/1990 | Pfaff | 439/296 |
| 5,057,031 | A | * | 10/1991 | Sinclair | 439/261 |
| 5,123,855 | A | * | 6/1992 | Petersen | 439/263 |
| 5,622,514 | A | * | 4/1997 | Crompton, III et al. | 439/342 |
| 5,707,247 | A | * | 1/1998 | Konstad | 439/342 |
| 5,730,615 | A | * | 3/1998 | Lai et al. | 439/342 |
| 5,791,928 | A | * | 8/1998 | Lai | 439/342 |
| 5,808,870 | A | | 9/1998 | Chiu | 361/705 |
| 5,833,483 | A | | 11/1998 | Lai et al. | 439/342 |
| 5,850,691 | A | | 12/1998 | Bell | 29/845 |
| 5,855,489 | A | * | 1/1999 | Walker | 439/342 |
| 6,065,990 | A | * | 5/2000 | McHugh et al. | 439/342 |
| 6,071,140 | A | * | 6/2000 | McHugh et al. | 439/342 |
| 6,083,028 | A | * | 7/2000 | Pei et al. | 439/342 |
| 6,086,402 | A | * | 7/2000 | Huang | 439/342 |
| 6,109,947 | A | * | 8/2000 | Lin | 439/342 |
| 6,217,361 | B1 | * | 4/2001 | Murr | 439/342 |

* cited by examiner

*Primary Examiner*—Brian Sircus
*Assistant Examiner*—Thanh-Tam Le

(57) ABSTRACT

A zero or low insertion force socket coupling mechanism is actuated by rotation of a flat blade screwdriver or other like tool. The actuation device includes a receptacle in the shape of the arabic letter "S." Placing the blade of the screwdriver in the receptacle and rotating the screwdriver moves the upper portion of the apparatus relative to the lower portion to line up the pins with the sockets. The shape of the receptacle enables the force created by the twisting motion of the screwdriver to be placed on the sides of the receptacle by the sides of the blade, rather than the ends of the blade, which could damage the molded plastic component. As a result, the actuation device avoids the waste of space of convention lever actuated devices. Moreover, the actuation device enables the use of a commonly available tool to actuate the coupling mechanism.

15 Claims, 7 Drawing Sheets

ZERO INSERTION FORCE SOCKET ACTUATION TOOL

BACKGROUND OF THE INVENTION

The present invention relates generally to zero or low insertion force sockets, and more particularly to an actuator for a zero or low insertion force socket.

A Pin Grid Array (PGA) package is a square or rectangular Integrated Circuit (IC) package with rigid pins coming out the bottom for inserting into sockets. Because a PGA package may be inserted into a socket, such as a Zero insertion Force (ZIF) socket, where it will be retained without soldering, PGA packages are readily interchangeable. When it is desired to replace a PGA package, the existing PGA package may be readily and quickly removed by simply popping the existing PGA package out of its socket and inserting a new PGA package in its place. PGA packages have been used for approximately 20 to 25 years and are especially popular in the Personal Computer (PC) industry due to the interchangeability they provide. As microprocessor IC chips become faster and faster, the PGA package in which they are housed may be easily removed and replaced with a PGA package housing a faster microprocessor IC chip.

Typical ZIF sockets include an actuation device for moving the attached CPU component. A known ZIF socket, for example, includes an actuation device that consists of an exposed lever and an embedded rotation bar wherein the rotation bar is joined with the lever at one end and the bar further includes multiple cam sections or crank shaft sections. When the bar is vertical in a right angle position with regard to the base, the pins of the CPU component can be inserted into a socket under ZIF conditions. Successively, the operator manually pushes the lever downward to the horizontal position, the cam sections or the crank shaft sections of the rotation bar move the CPU component horizontally, and the pins of the CPU component engage with the corresponding contacts of the socket.

In contrast, when the lever is moved from zero degrees (horizontal position) back to ninety degrees (vertical position), the cover may be moved horizontally in a reverse direction. Therefore, the engagement between the contacts of the socket and the corresponding pins of the CPU component may be released, and the CPU component can be detached from the socket.

When the lever is positioned in a horizontal position, some space on the PC board will be occupied because the lever is close to the PC board in this configuration, which wastes space on the PC board. From another viewpoint, there are many electrical components near the lever, thus resulting in inconvenience to operatively access the lever.

The present invention is therefore directed to the problem of developing a zero or low insertion force connection that does not require space above the actuator to actuate the connection.

SUMMARY OF THE INVENTION

The present invention solves this problem by providing an actuator for a zero or low insertion force connection that can be activated by using a screwdriver or other like tool. Moreover, by providing that the screwdriver or other like tool actuates the socket using the sides of the screwdriver or other like tool instead of the edges the present invention prevents damage to the socket actuator.

According to one aspect of the present invention, a socket assembly for receiving a pin grid array includes a cover, a housing and at least one receptacle. The cover includes multiple sockets for receiving pins in the pin grid array. The housing holds the cover, which is movable relative to the housing. Movement of the cover relative to the housing causes engagement and disengagement of the pins with the sockets. The receptacle is formed between the cover and the housing and has a curved shape for receiving a flat blade of a tool.

According to another aspect of the present invention, in the above socket assembly the cover is movable relative to the housing by rotation of the tool when the flat blade is inserted into the receptacle.

According to another aspect of the present invention, in the above socket assembly the first receptacle includes two shoulder portions.

According to another aspect of the present invention, in the above socket assembly the two shoulder portions receive a force applied by sides of the flat blade when the tool is rotated.

According to another aspect of the present invention, in the above socket assembly a second receptacle is provided with a shape for accepting a flat blade of a tool.

According to another aspect of the present invention, in the above socket assembly the second receptacle includes a curved shape.

According to another aspect of the present invention, in the above socket assembly a protrusion is disposed on the cover and two notches are disposed on the housing.

According to another aspect of the present invention, in the above socket assembly the protrusion travels from one of the two notches to the other notch when the cover travels from an open position to a closed position.

According to another aspect of the present invention, in the above socket assembly a locking icon is disposed adjacent to the first receptacle, which locking icon identifies a function of the receptacle.

According to another aspect of the present invention, in the above socket assembly a rotation icon is disposed adjacent to the first receptacle, which rotation icon indicates a direction of rotation of the tool to engage the pins of the pin grid array with the sockets.

According to another aspect of the present invention, in the above socket assembly an unlocking icon is disposed adjacent to the second receptacle, which identifies a function of the second receptacle.

According to another aspect of the present invention, in the above socket assembly a direction icon is disposed adjacent to the second receptacle, which direction icon indicates a direction of motion of the blade of the tool to disengage the pins of the pin grid array from the sockets.

According to another aspect of the present invention, a method for engaging pins of a pin grid array with sockets in a socket assembly includes at least three steps. First, a tool having a flat blade is inserted into a curve-shaped receptacle having two shoulders. Next, the tool is rotated so the sides of the flat blade push against the shoulders of the curve-shaped receptacle. Finally, a cover of the socket assembly is moved relative to the housing in response to the rotation of the tool thereby engaging the pins of the pin grid array in the sockets of the socket assembly.

According to another aspect of the present invention, the above method for engaging pins of a pin grid array with sockets in a socket assembly also preferably includes the step of moving a protrusion from a first cutout to a second cutout as the cover moves laterally relative to the housing.

According to another aspect of the present invention, the above method for engaging pins of a pin grid array with sockets in a socket assembly also preferably includes the step of providing a tactile feedback sensation to an operator of the tool upon reaching full travel of the cover relative to the housing.

According to another aspect of the present invention, the above method for engaging pins of a pin grid array with sockets in a socket assembly also preferably includes the step of providing a visual indicator indicating which direction the tool must be rotated to engage the pins in the sockets.

According to another aspect of the present invention, the above method for engaging pins of a pin grid array with sockets in a socket assembly also preferably includes the step of providing a visual icon indicating which receptacle engages the pins in the sockets and which receptacle disengages the pins from the sockets.

According to another aspect of the present invention, an apparatus for actuating a socket assembly having a cover and a housing includes several means. First, the apparatus includes a means for accepting a flat blade tool. In addition, the apparatus includes a means for transferring a force from the sides of the flat blade tool to the means for accepting the flat blade tool. Moreover, the apparatus includes a means for moving the cover of the socket assembly relative to the housing of the socket assembly in response to the force received means for accepting the flat blade tool.

According to another aspect of the present invention, the above apparatus also includes means for providing a tactile feedback sensation to an operator of the flat blade tool to indicate when the cover has completed its travel relative to the housing.

According to another aspect of the present invention, the above apparatus also includes means for indicating to the user a function of each of two receptacles and a direction of rotation of the flat blade tool to perform the associated function.

DETAILED DESCRIPTION

The present invention relates to a Screwdriver Actuated ZIF (SAZ) socket. This socket is designed to eliminate damage during installation and replacement of high pin count Micro PGA devices without the need for expensive insertion/extraction tools. The Micro Pin Grid Array (PGA) socket of the present invention features Zero Insertion Force (ZIF) mating and unmating. The SAZ socket features a cover that keeps the empty socket in the "OPEN" position. A standard 0.635[0.250] wide slotted screwdriver is all that is needed to actuate the socket.

Figure 7:
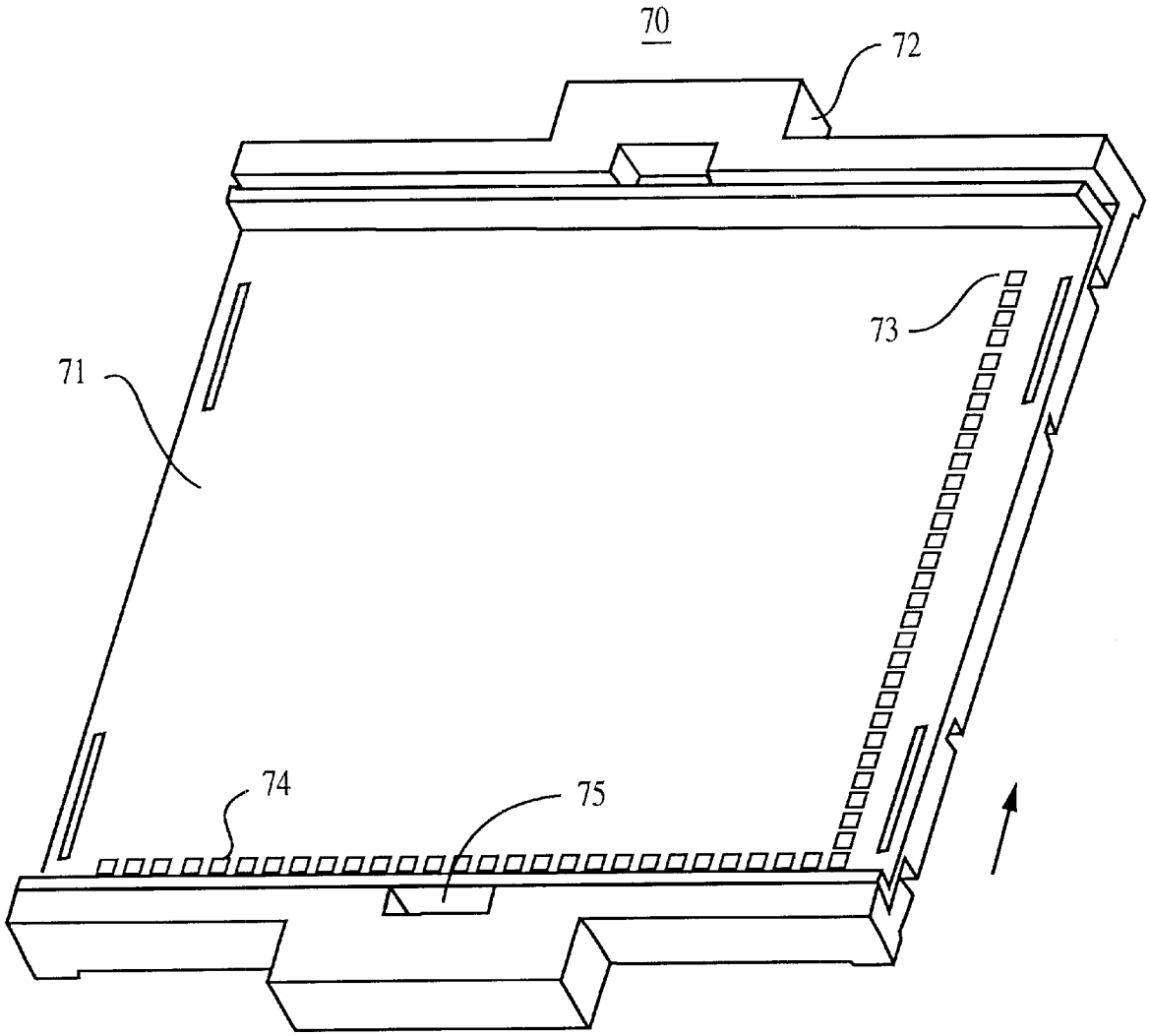
FIG. 7 depicts a conventional socket assembly for receiving a pin grid array, such as is used in CPU integrated circuits.

Referring to FIG. 7, shown therein is a conventional socket assembly 70 for receiving the pins from a Pin Grid Array (PGA), for example. The assembly 70 consists of a cover 71 and a housing 72. The cover 71 moves relative to the housing 72 to lock the PGA in place or to disengage the PGA. Only one row of sockets 73 and one column of sockets 74 are shown, however, conventional designs usually consist of many rows and columns, such as 24×26.

To move the cover 71 relative to the housing 72, a lever and cam assembly (not shown) is used. Pushing the lever down rotates a cam into the slot 75 shown in FIG. 7, which moves the cover 71 in the direction shown by the arrow 18. To move the cover 71 back, the lever is lifted, which rotates another cam and moves the cover 71 back.

Figure 1A:
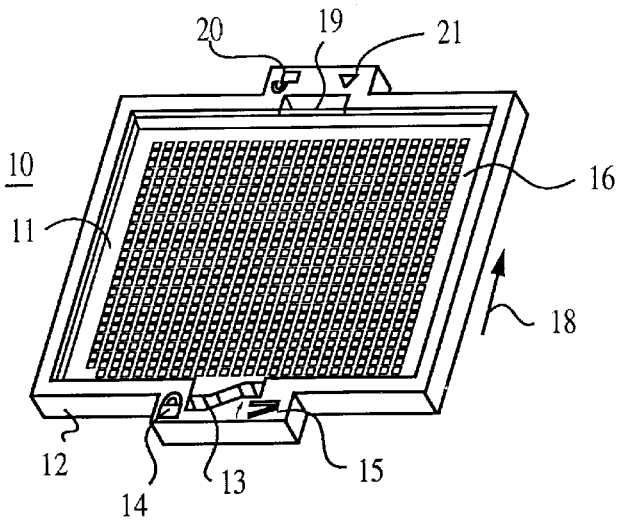
FIG. 1A depicts an exemplary embodiment of a micro pin grid array socket according to the present invention.

Referring to FIG. 1A, an exemplary embodiment of the socket assembly 10 according to the present invention is shown. The socket assembly includes a cover 11 and a housing 12. The socket assembly 10 includes 26 rows and 24 columns of sockets 16, however, the actual number of sockets 16 is not limited to this embodiment. Any number of sockets 16 may be employed in the socket assembly 10 of the present invention without departing from the scope of the invention.

The pin grid array 41 (see FIG. 4A) is inserted, lightly pressed into place into the socket assembly 10 (see FIG. 4B) and locked in place by lateral movement of the cover 11 relative to the housing 12. The lateral movement is caused by inserting a screwdriver or like tool (see FIGS. 5A and 5B) into the receptacle 13 and rotating the screwdriver clockwise (in this embodiment), which rotation moves the cover 11 laterally in the direction of the arrow 18 relative to the housing 12, thereby engaging the pins of the pin grid array 41 with the sockets 16 in the socket assembly 10.

Figure 1B:
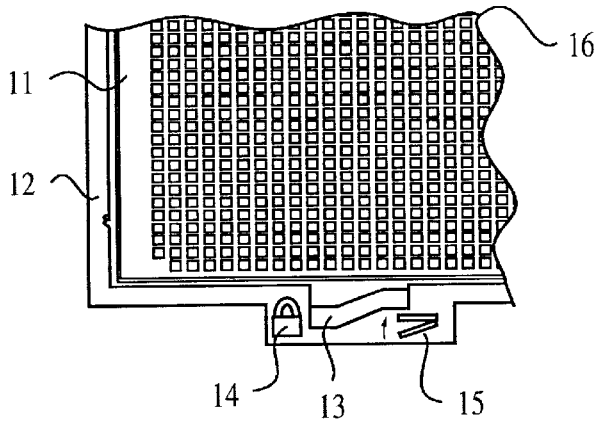
FIG. 1B depicts a portion of the exemplary embodiment of FIG. 1A in a top detail view.

Referring to FIG. 1B, shown therein is a detailed top view of a portion of the socket assembly 10. When the socket assembly 10 is in the open position, i.e., the pins of the pin grid array 41 are not engaged with the sockets 16, there is no space between the cover 11 and the housing 12 at the edge of the cover 12 where the socket receptacle 13 is disposed.

Also shown in FIG. 1B are visual directions or icons 14, 15, (also see elements 20, 21 in FIG. 1A) indicating the direction of rotation of the screwdriver to lock the pin grid array 41 to the socket assembly 10. Indicator 14 in the shape of a lock coupled with indicator 15 informs the user that rotation of the screwdriver in the clockwise direction locks the pins in the pin grid array 41 to the sockets 16 in the socket assembly 10. Similarly, icons 20 and 21 indicate to the user that insertion of the screwdriver into the receptacle 19 and moving the cover 11 relative to the housing 12 in the direction indicated by icon 21 unlocks the pin grid array 41. The unlock icon 20 indicates this to the user.

Figure 1C:
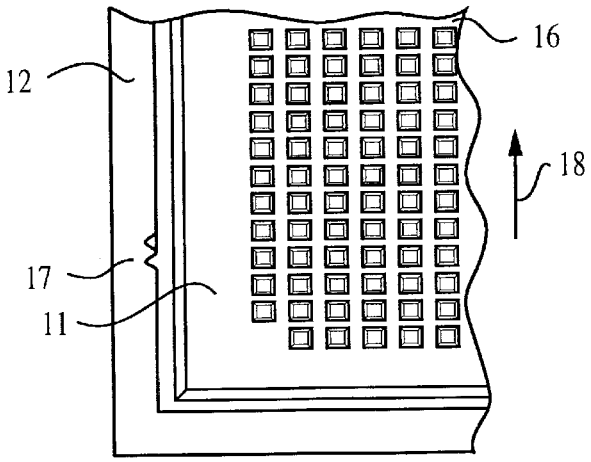
FIG. 1C depicts a further detailed top view of a portion of the exemplary embodiment of FIG. 1B.

Referring now to FIG. 1C, shown therein is a further detailed top view of a portion of the socket assembly 10. Detent assembly 17 provides a tactile feedback sensation to the user when the pins of the pin grid array 41 are completely engaged with the sockets 16. When the cover 11 has moved as far laterally relative to the housing 12 in the direction of the arrow 18 as possible, the detent assembly 17 provides a click to the user to inform the user that further rotation of the screwdriver is not necessary, thereby preventing excess force from being exerted on the socket receptacle 13. Further details of the detent assembly 17 can be seen in FIGS. 6A and 6B.

Figure 2:
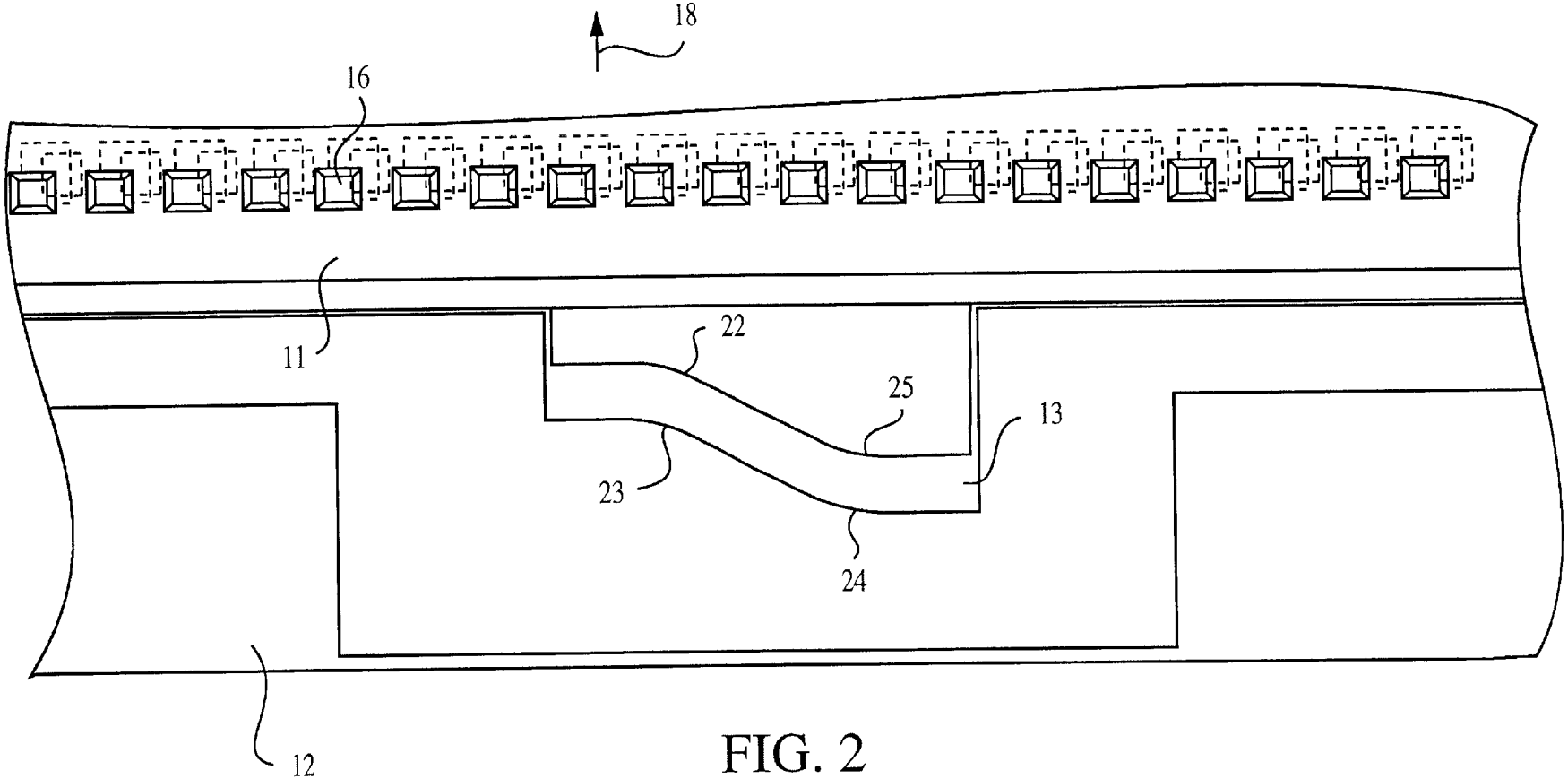
FIG. 2 depicts a detailed view of an alternative embodiment of the socket actuator receptacle according to the present invention.

An alternative embodiment of the socket receptacle of the present invention is shown in FIG. 2. In this alternative embodiment, the shape of the socket receptacle is such that rotation of the screwdriver is opposite to that of FIGS. 1A–C to engage the pin grid array 41. In other words, in this embodiment to engage the pins of the pin grid array 41 with the sockets 16 of the socket assembly 10 the screwdriver must be rotated in the counter-clockwise direction. To disengage the pins of the pin grid array 41 from the sockets 16 of the socket assembly, the screwdriver must be rotated in the clockwise direction.

As can be seen in FIGS. 1A–1C and the alternative embodiment of FIG. 2, a specially-shaped receptacle 13 is used in place of the lever and cam assembly of the prior art. Several embodiments of the socket assembly 10 are possible. One of the specially-shaped receptacles 13 may be disposed on each side of the socket assembly 10. One for engaging the pins of the pin grid array with the sockets 16 of the socket assembly 10, and another for disengaging the pins of the pin grid array from the sockets 16 of the socket assembly 10.

Alternatively, as shown in FIG. 1A, a rectangular receptacle 19 can be used to disengage the pins from the sockets 16, as the forces required to disengage are much less than the forces necessary to engage the pins with the sockets 16, which means that the specially shaped receptacle 13 is not as necessary for disengagement of the pin grid array 41. The shape of the receptacle 13 is designed to minimize the forces from the screwdriver on the receptacle 13 to prevent damage to the plastic receptacle 13. With a large number of pins, the forces to engage the pins to the sockets 16 can be rather large, and without the provision of the specially-shaped receptacle 13 one might damage the plastic receptacle 13.

The receptacle 13 is formed by a space provided between the cover 11 and the housing 12. Insertion of the blade of a screwdriver, for example, into the receptacle 13 and rotation of the blade will move the cover 11 relative to the housing 12, thereby engaging the pins of the pin grid array 41 with the sockets 16 of the socket assembly in the known manner. Insertion of the blade of a screwdriver, for example, into the receptacle 19 on the opposite side and rotation of the blade will move the cover 11 relative to the housing 12, thereby disengaging the pins of the pin grid array 41 with the sockets 16 of the socket assembly 10 in the known manner.

Figure 3:
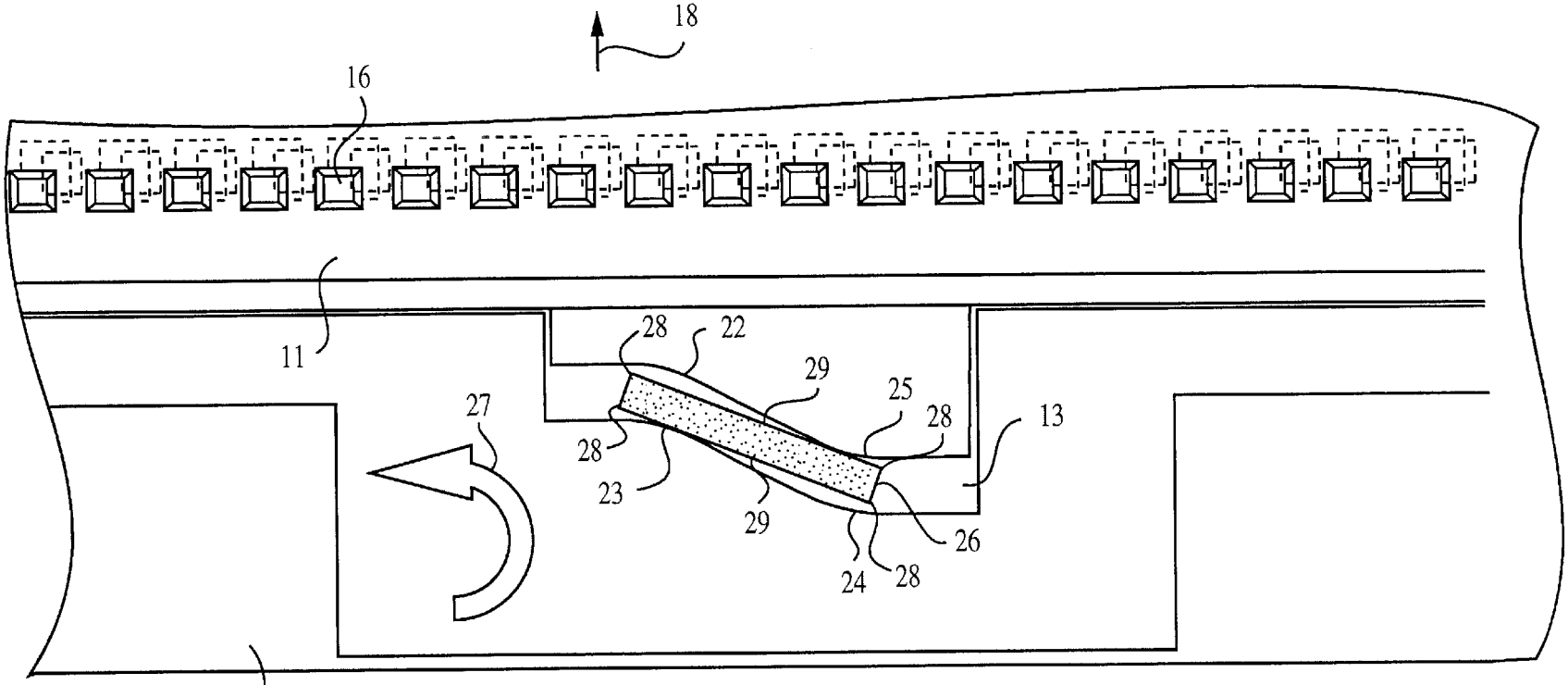
FIG. 3 depicts the socket actuator receptacle shown in FIG. 2 with the blade of a screwdriver or other like tool inserted into the actuation receptacle.

Referring to FIG. 3, shown therein is the embodiment of the receptacle of FIG. 2 with the blade 26 of the screwdriver inserted into the receptacle 13. The shape of the receptacle 13 is selected to prevent damage to the molded plastic components of the housing 12 and cover 11. By employing a receptacle 13 with shoulders 22–25, the force applied to the shoulders 22–25 of the receptacle 13 can reach 45–50 lbs without damaging the molded plastic components, which force is necessary to engage the pins of the PGA with the sockets 16. Due to the shape of the receptacle 13, the force is applied by the sides 29 of the screwdriver blade 26 to the receptacle 13, rather than by sharp edges 28 of the blade 26. During rotation of the screwdriver blade 26, the point at which the force is received by the receptacle 13 will move continuously along the shoulders 22–25 of the receptacle 13. For example, during rotation of the blade 26 in the direction of the arrow 27 the force applied by the blade 26 is applied by the sides 29 of the blade 26 at shoulders 23 and 25, while the sharp edges 28 are free to travel without contacting any part of the receptacle 13. When rotating the blade 26 in a direction opposite to the arrow 27, the force applied by the blade 26 to the receptacle 13 will be applied by the sides 29 of the blade 26 at shoulders 22 and 24, and as before the sharp edges 28 of the blade 26 are free to travel without contacting any part of the receptacle 13. Consequently, the shape of the receptacle 13 is designed to ensure that the shoulders 22–25 of the receptacle 13 remain in contact with the sides 29 of the blade 26, thereby ensuring that the force applied by the blade 26 and received by the receptacle 13 will be felt at the shoulder portions 22–25 of the receptacle 13 at all times. Due to the design of the receptacle 13, essentially a fulcrum is created where the one side 29 of the blade 26 touches the shoulders 22–25 of the receptacle 13, allowing the force to be applied by the sides 29 of the screwdriver rather than the edges 28, which might damage the plastic molded receptacle 13. The design of the receptacle 13 is such that the edges 28 of the blade 26 can move without touching the receptacle 13.

Alternate designs of the receptacle 13 include two shoulder sections with open ends, or two rounded bumps. Other possible designs would be evident to those of skill in the art based on this disclosure.

Figure 4A:
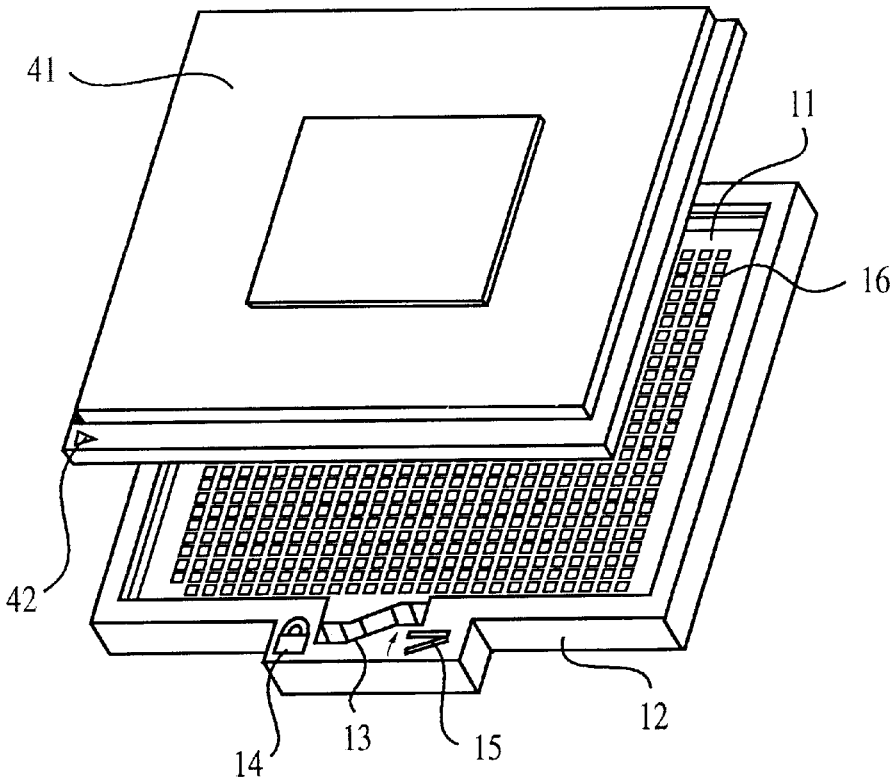
FIG 4A depicts insertion of the pin grid array into the socket of the present invention.

Referring to FIG. 4A, shown therein is the insertion of the pin grid array 41 into the socket assembly 10. The corner marker 42 in the pin grid array 41 lines up with the missing sockets in the array of sockets 16 to enable the user to correctly line up the pins with the sockets 16.

Figure 4B:
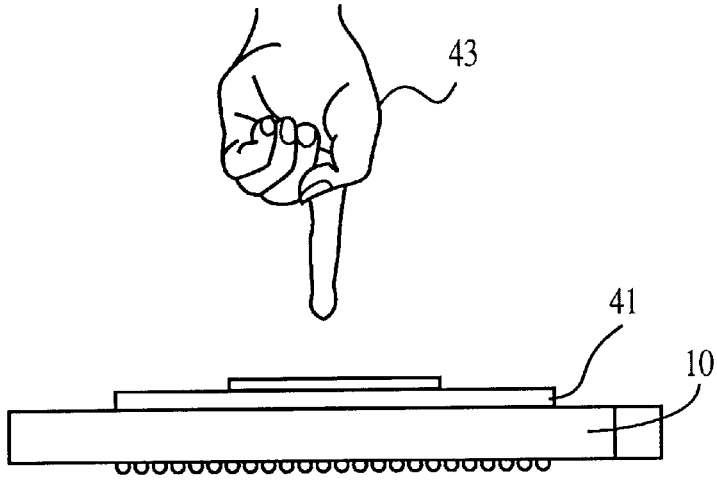
FIG. 4B depicts the pin grid array mounted into the socket of the present invention in side view.

Referring to FIG. 4B, shown therein is a side view of the pin grid array 41 inserted into the socket assembly 10. The finger 43 indicates that the user must apply a small force to the top of the pin grid array 41 to ensure that the pin grid array is flat against the bottom of the cover 11 of the socket assembly 10.

Figure 5A:
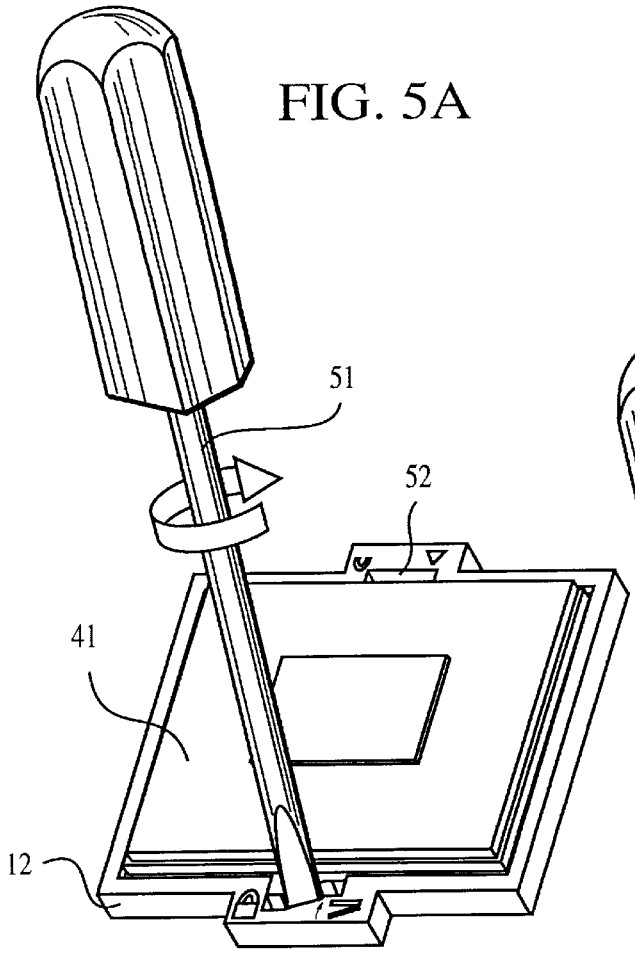
FIG. 5A depicts the use of a screwdriver tool to mate the pin grid array to the socket.

Referring to FIG. 5A, once the pin grid array 41 is inserted into the socket assembly 10, a screwdriver 51 is inserted into the socket and rotated (in this embodiment) clockwise to engage the pins with the sockets 16.

Figure 5B:
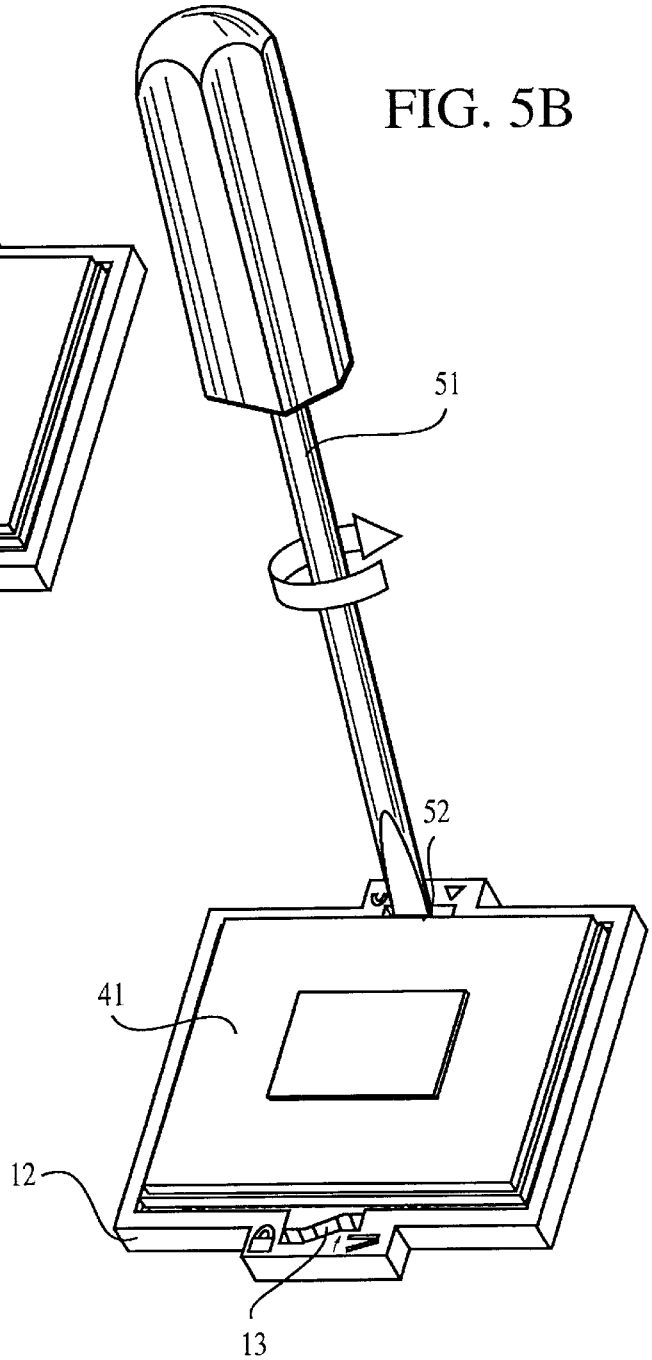
FIG. 5B depicts the use of a screwdriver tool to unmate the pin grid array from the socket.

Referring to FIG. 5B, to disengage the pins of the pin grid array 41 from the sockets 16 of the socket assembly 10, the screwdriver 51 is placed in the receptacle 52 on the top of the socket assembly (opposite to the receptacle 13 used to engage the assembly) and the screwdriver 51 is rotated clockwise.

Figure 6A:
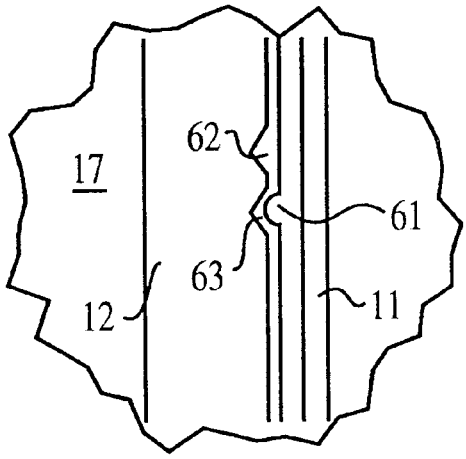
FIG. 6A depicts a further detailed top view of a portion of the exemplary embodiment of FIG. 1C in the open position.
Figure 6B:
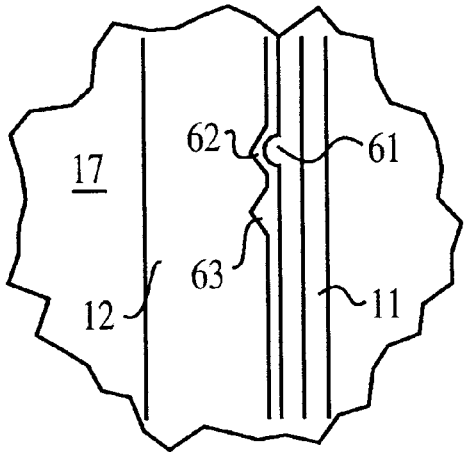
FIG. 6B depicts a further detailed top view of a portion of the exemplary embodiment of FIG. 1C in the closed position.

Referring to FIG. 6A, which is a detailed view of the detent assembly 17, a protrusion 61 on the edge of the cover 11 moves between two cutouts 62, 63 in the housing 12 when the cover 11 moves relative to the housing 12. FIG. 6A shows the detent assembly 17 when the socket assembly 10 is in the open position. In this position, the pins of the pin grid array 41 are not engaged with the sockets 16 of the socket assembly 10. When the cover 11 moves relative to the housing 12 as a result of the screwdriver 51 action, the protrusion moves from cutout 63 to cutout 62, as shown in. FIG. 6B, which depicts the detent assembly in the closed position. The closed position is when the pins of the pin grid array 41 are engaged with the sockets 16 of the socket assembly 10. When the screwdriver 51 action disengages the pins from the sockets 16, the detent assembly 17 changes from the position shown in FIG. 6B to the position shown in FIG. 6A. When the protrusion moves from one cutout portion 62, 63 to the other, a tactile feedback sensation is provided to the user to indicate that the cover 11 has completed its travel relative to the housing 12. This ensures that the user will not apply undue force to the socket actuator 13.

In summary, the present invention provides a quick, easily manufactured technique to engage and disengage the pin grid array with the socket assembly without occupying additional space on the printed circuit board.

What is claimed is:

1. A socket assembly for receiving a pin grid array comprising:

a) a cover having a plurality of sockets for receiving a plurality of pins in the pin grid array;

b) a housing in which the cover is disposed, wherein said cover is movable relative to the housing, and movement of the cover relative to the housing causes engagement and disengagement of the pins with the sockets;

c) a first receptacle formed between the cover and the housing, said receptacle having a curved shaped for receiving a flat blade of a tool; the curved shape having shoulders provided thereon for engaging sides of the flat blade of the tool;

whereby the shoulders remain in contact with the sides of the flat blade when the flat blade is rotated to move the cover, thereby ensuring that the force applied by the flat blade will be transmitted through the shoulders to maintain the integrity of the first receptacle and the socket assembly.

2. The socket assembly according to claim 1, wherein the first receptacle includes two shoulder portions.

3. The socket assembly according to claim 1, further comprising a second receptacle shaped to accept a flat blade of a tool.

4. The socket assembly according to claim 3, wherein the second receptacle includes a curved shape.

5. The socket assembly according to claim 1, further comprising a protrusion disposed on the cover and two notches disposed on the housing.

6. The socket assembly according to claim 5, wherein the protrusion travels from one of the two notches to the other of the two notches when the cover travels from an open position to a closed position.

7. The socket assembly according to claim 1, further comprising a locking icon disposed adjacent to the first receptacle identifying a function of the first receptacle.

8. The socket assembly according to claim 1, further comprising a rotation icon disposed adjacent to the first receptacle indicating a direction of rotation of the tool to engage the pins of the pin grid array with the sockets.

9. The socket assembly according to claim 3, further comprising an unlocking icon disposed adjacent to the second receptacle identifying a function of the second receptacle.

10. The socket assembly according to claim 3, further comprising a direction icon disposed adjacent to the second receptacle indicating a direction of motion of the blade of the tool to disengage the pins of the pin grid array from the sockets.

11. A method for engaging a plurality of pins of a pin grid array to a plurality of sockets in a socket assembly comprising the steps of:

a) inserting a tool having a flat blade into a curve-shaped receptacle having two shoulders;

b) rotating the tool so the sides of the flat blade push against the shoulders of the curve-shaped receptacle; and c) moving a cover of the socket assembly relative to the housing in response to the rotation of the tool thereby engaging the pins of the pin grid array with the sockets of the socket assembly.

12. The method according to claim 11, further comprising the step of moving a protrusion from a first cutout to a second cutout as the cover moves laterally relative to the housing.

13. The method according to claim 11, further comprising the step of providing a tactile feedback sensation to an operator of the tool upon reaching full travel of the cover relative to the housing.

14. The method according to claim 11, further comprising the step of providing a visual indicator indicating which direction the tool must be rotated to engage the pins in the sockets.

15. The method according to claim 11, further comprising the step of providing a visual icon indicating which receptacle engages the pins in the sockets and which receptacle disengages the pins from the sockets.

* * * * *